United States Patent [19]

Strauch

[11] Patent Number: 4,969,626

[45] Date of Patent: Nov. 13, 1990

[54] ADJUSTABLE FORM FOR CASTING CONCRETE CULVERTS

[75] Inventor: C. Randolph Strauch, Bucyrus, Ohio

[73] Assignee: Hyway Contrete Pipe Company, Findlay, Ohio

[21] Appl. No.: 303,634

[22] Filed: Jan. 30, 1989

[51] Int. Cl.[5] ..... B28B 7/04

[52] U.S. Cl. ..... 249/94; 249/11; 249/12; 249/158; 249/159; 249/171; 249/194

[58] Field of Search ..... 249/10–12, 249/27, 47, 94, 97, 155, 158, 159, 170, 171, 185, 194

[56] References Cited

U.S. PATENT DOCUMENTS

| | | | |
|---|---|---|---|
| 1,049,436 | 1/1913 | Woolf | 249/171 |
| 1,384,514 | 7/1921 | Close | 249/12 |
| 1,407,246 | 2/1922 | Bond | 249/12 |
| 1,461,973 | 7/1923 | De La Mare | 249/159 |
| 3,685,783 | 8/1972 | Hilson | 249/94 |
| 3,825,220 | 7/1974 | Schmaltz | 249/194 |
| 4,055,321 | 10/1977 | Schimmel | 249/171 |
| 4,564,313 | 1/1986 | Niswander et al. | 249/11 |
| 4,673,159 | 6/1987 | Schmidgall | 249/159 |

FOREIGN PATENT DOCUMENTS

| | | | |
|---|---|---|---|
| 2812974 | 10/1979 | Fed. Rep. of Germany | 249/171 |

*Primary Examiner*—James C. Housel

*Attorney, Agent, or Firm*—Willian Brinks Olds Hofer Gilson & Lione

[57] ABSTRACT

An adjustable culvert form facilitates fabrication of rectilinear culverts and skewed culverts that is, culverts having an angular relationship between sidewalls and span. It is particularly useful for the production of three-sided culverts. The form generally defines a parallelogram having low, vertically standing sidewalls which are interconnected at adjacent ends by hinges. The hinges may be either a conventional pair of interleaved pivots coupled by a removable pin or a unique expandable, multiple pin hinge configuration. The form is placed on a smooth horizontal surface such as a previously poured concrete slab, the surface forming the largest continuous surface of the product. The culvert is cast in an inverted orientation. The width and length of the formed product may be adjusted by the incorporation or removal of sidewall panels. Triangular sidewall panels are secured to end adjacent regions of the sidewall panels to form haunches. The walls (legs) of the culvert are formed by square or correspondingly skewed wall forms extending upwardly from the haunch panels. Various inserts may be attached to the form to mold in-situ such features as key or rail securement sites.

15 Claims, 4 Drawing Sheets

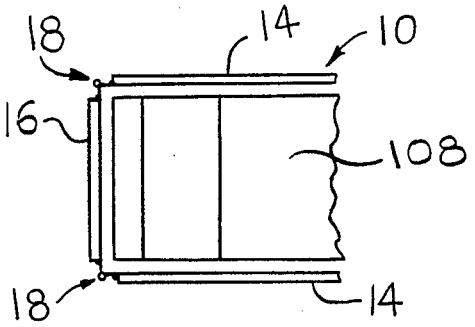
FIG. 11
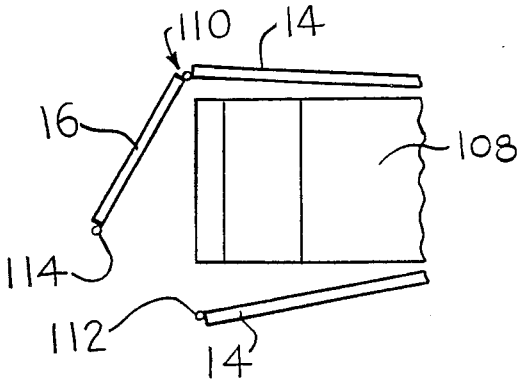
FIG. 12
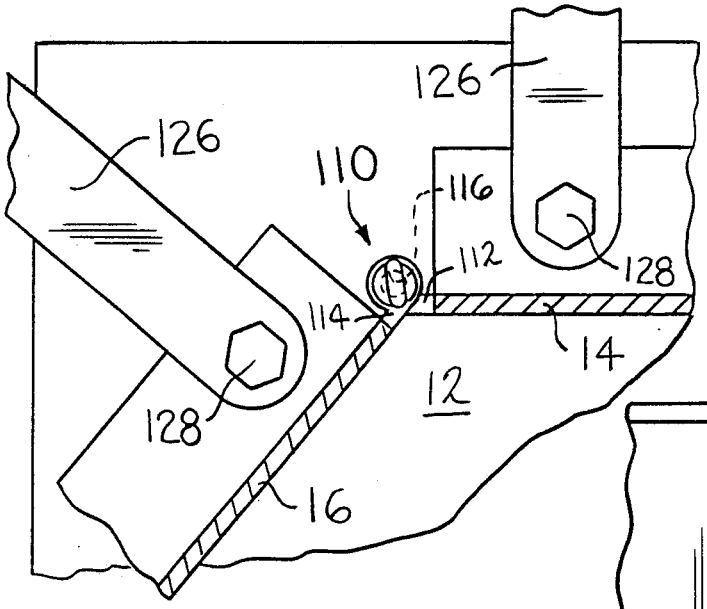
FIG. 13
FIG. 14
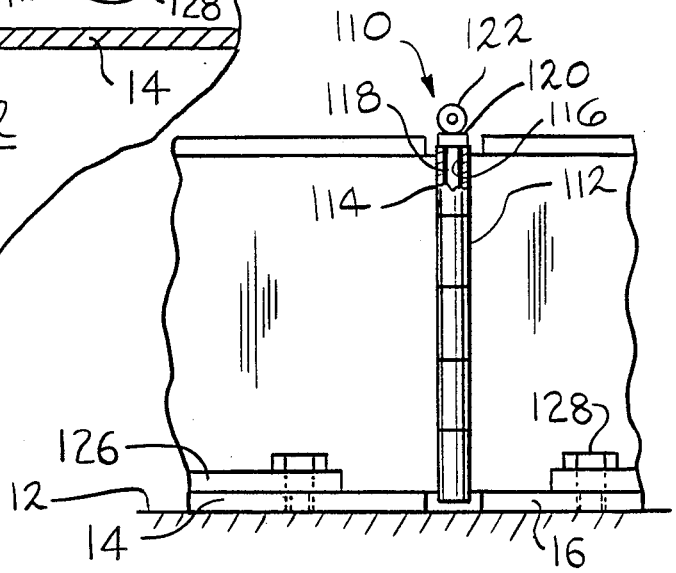
FIG. 15
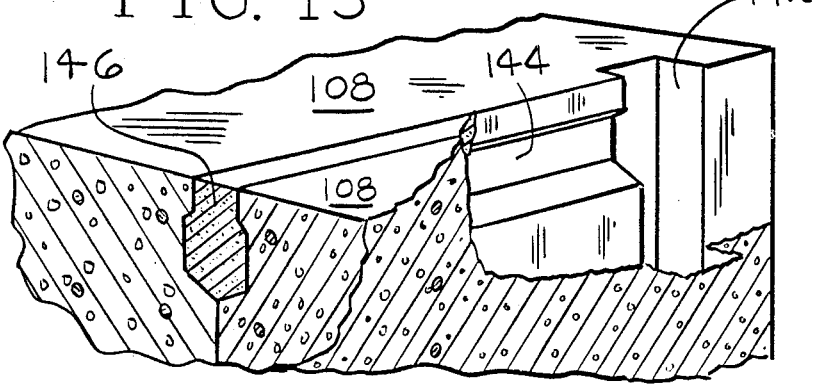

ADJUSTABLE FORM FOR CASTING CONCRETE CULVERTS

BACKGROUND OF THE INVENTION

The invention relates generally to cast concrete culverts and particularly to a method and apparatus for fabricating three-sided, rectangular and skewed culverts.

The use of concrete as a construction material is synonymous with the fabrication of sewer pipe, culverts and smaller bridges. Concrete's load bearing ability, resistance to environmental and service related deterioration and cost, support its claim as the basic and preeminent heavy construction material.

While being formed into a useful product, it must, however, be contained within a suitable form, as is well known. The expense of such a form or forms often represents a significant if not major portion of the total cost of a concrete structure, particularly if the forms are specially constructed to produce it. On the one hand, a durable, reusable, often metal form may be relied upon to fabricate thousands of standard pieces such as pipes or septic tanks. On the other hand, unique structures may require one of a kind wood forms constructed by skilled carpenters at significant expense. Such forms are filled, stripped from the product and oftentimes destroyed, due to the significant labor expense attendant recovery of the individual form components.

It is therefore not surprising that significant effort has been directed toward producing forms that are adjustable, readily strippable and reusable.

One such form is disclosed in U.S. Pat. No. 2,265,871 to Scott. In the apparatus disclosed, a plurality of relatively small panels are releasably secured to one another to construct a form of the desired shape. Although the form components are reusable, it appears that significant assembly and breakdown time by relatively skilled labor would be required in order to adjust the form and thus the size and proportions of culverts fabricated with it.

Another concrete form on a somewhat larger scale is disclosed in U.S. Pat. No. 3,693,927 to Jennings. Here, the forms are used in the construction of box culverts or modular buildings. A pair of inner frame units are connected together for relative bidirectional motion and support a top (ceiling) panel forming member and release plate. While providing a readily reusable form, this apparatus is adjustable only over a certain limited range. Furthermore, over this limited range or any other initially chosen limited range, the cost of initially fabricating the casting apparatus appears to be significant and in view of its limited adjustability might render production costs of a small number of units unacceptably high.

U.S. Pat. No. 3,696,177 discloses another means for forming concrete box culverts and similar structures. This patent discloses a structure and apparatus similar to that discussed immediately above. That is, mold sections which are bidirectionally translatable define and support the inner and outer surfaces of the culvert. The form sections are fabricated of steel. When the concrete is set, the forms are moved away from the completed structure and may then be readily reused. Here, too the range of adjustability of a given form is limited and the initial expense of fabricating the form appears to be significant.

One difficulty with all of the foregoing devices is that they are intended to fabricate only four sided, rectilinear (right angle) culvert structures and the like, that is, structures wherein the planes of the sidewalls are perpendicular to the transverse axis of the top panel and wherein the opening is uniform in cross section and perpendicular to the transverse axis of the top panel. It has been found, however, that in the natural world not all streams, rivers, railroads and highways intersect at right angles. While all rectilinear culverts may be utilized to span an angularly oriented obstacle, they do not accomplish this task efficiently in that they must be of a span sufficient to accept the total angular width of the obstacle. Thus, the above discussed devices do not allow for the fabrication of culverts which most efficiently provide a crossing over obstacles oriented at angles other than right to the path of crossing. By way of contrast, a culvert wherein the opening is oriented obliquely relative to the top panel at approximately the same angle as the angle between the obstacle and the crossing path minimizes the span width as well as the total amount of material in the culvert.

A second difficulty of the discussed adjustable forms is their dedication to construction of standard box culverts. Significant benefits such as material saving and attendant reductions in transportation and construction costs flow from the construction of three sided (bottomless) culverts according to our co-owned invention set forth in U.S. Pat. No. 4,564,313 which is hereby incorporated in its totality by reference. Adjustable forms for the production of skewed, three sided culverts have not heretofore been available.

From a review of the prior art it is thus apparent that improvements in the art of culvert structures as well as their forms and construction methods are both desirable and possible.

SUMMARY OF THE INVENTION

The invention is directed to an adjustable culvert form which facilitates fabrication of three sided culverts of both rectilinear and skewed configurations. The resulting culvert product and the method of fabricating same are also disclosed herein. All of these teachings relate as well to the fabrication of transitional culvert sections, that is, culverts in which the walls define converging vertical planes and the culvert is symmetrical about a vertical midplane perpendicular to the culvert faces as well as radial sections wherein the walls are parallel but the faces define converging vertical planes and the culvert is symmetrical about a vertical midplane intersecting the sidewalls.

The form generally defines a parallelogram having low vertically standing sidewalls which are placed upon a smooth horizontal surface such as a previously poured concrete slab. The product is cast upside down and thus the slab forms what will ultimately become the upper surface of the product. The upper surface of the form, which produces the underside of the culvert, is open. Thus both the upper and lower faces of the culvert slab are formed with either an inexpensive and unspecialized form or no form at all. This form configuration provides significant cost savings over prior art form designs because of the reduced surface area of the form and thus reduced material usage.

At each corner of the parallelogram is a hinge. The hinges may be either a conventional pair of interleaved pivots coupled by a removable pin or a unique, expandable multiple pin configuration. The latter hinge structure not only facilitates pivoting of the corners to provide a form and product having the desired skew but also opens to relax the form and facilitate release of the product therefrom. The width and length of the product may be adjusted by the incorporation or removal of selected lengths of sidewall panels. Pairs of triangular sections of sidewall removably secured to end adjacent regions of the long sidewalls of the form define the triangular haunch sections of the culvert. The legs of the culvert are formed by rectangular or correspondingly skewed wall forms extending upwardly from the lower, sidewall and haunch panels of the forms.

A selection of inserts has been designed which may be placed within the form and attached thereto to form, in situ, various optional structures. For example, elongate bars may be secured to the inside walls of the forms to form keys extending along faces of the culvert which will be juxtaposed similarly configured culverts, the keys thereby formed being filled with grout to securely interconnect such adjacent culverts in a multiple culvert installation. Securement means may also be positioned within the forms for casting in situ which will receive bolts for securing guard rail and similar structures to the outside faces of the outside culverts in appropriate installations.

Thus it is an object of the present invention to provide a form for the expedient and repeated fabrication of cast concrete culverts.

It is a further object of the present invention to provide a reusable form for the production of rectangular, skewed, radial and transitional three sided culverts.

It is a further object of the present invention to provide a reusable form with an open top and bottom.

It is a further object of the present invention to provide a method for the fabrication of cast concrete culverts.

It is a further object of the present invention to provide a method for the fabrication of rectangular, skewed, radial and transitional three sided culverts.

It is a still further object of the present invention to provide precast, three sided concrete culverts having certain structures and features cast in situ.

Further objects and advantages of the instant invention will become apparent by reference to the following description of the preferred embodiment and appended drawings.

BRIEF DESCRIPTION OF THE DRAWINGS

FIG. 11 is a diagrammatic, top plan view of a culvert form according to the present invention with the hinges open to facilitate removal of the cast culvert from the form:

FIG. 12 is a diagrammatic, top plan view of a culvert form with alternate embodiment hinges according to the present invention with a hinge pin removed to facilitate removal of the cast culvert from the form;

FIG. 13 is an enlarged, fragmentary plan view of an alternate embodiment hinge structure according to the present invention;

FIG. 14 is an enlarged fragmentary elevational view of an alternate embodiment hinge structure according to the present invention:

FIG. 15 is a fragmentary, perspective view of abutting culvert faces and the key configuration:

DESCRIPTION OF THE PREFERRED EMBODIMENTS

Figure 1:
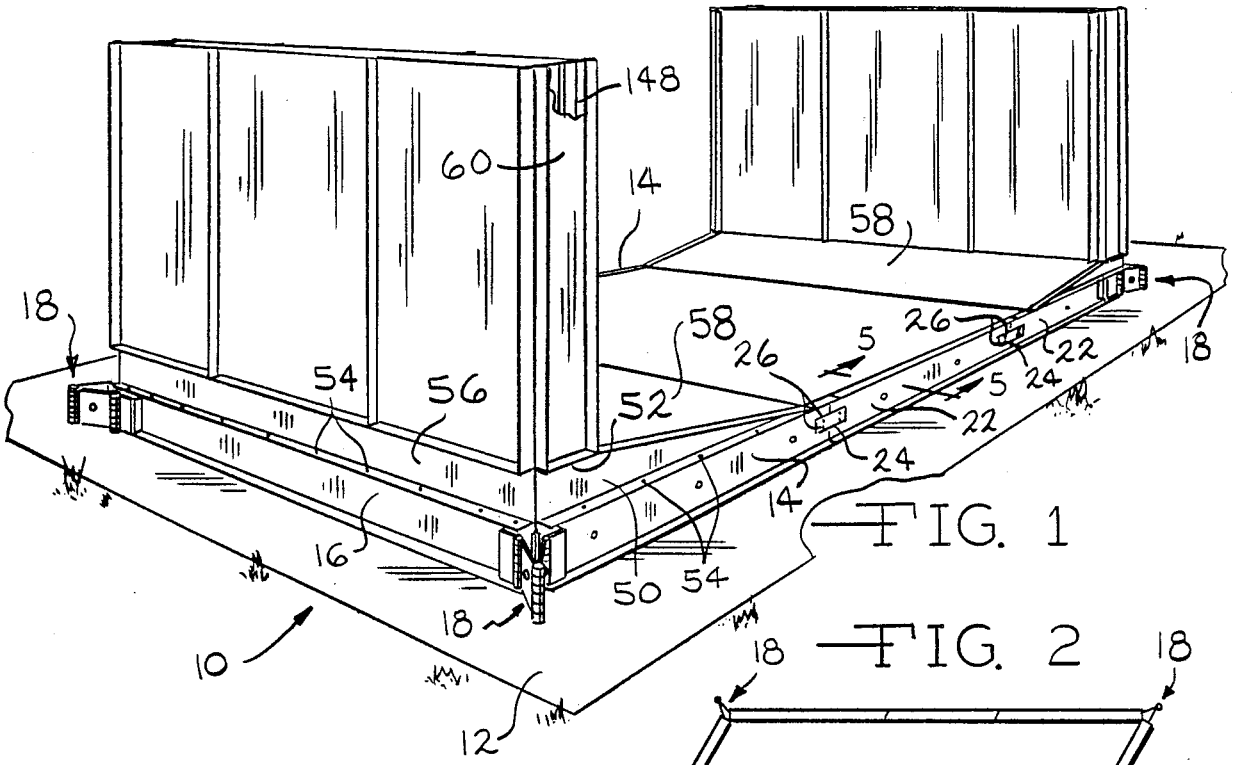
FIG. 1 is a perspective view of a form for the production of concrete culverts according to the present invention.
Figure 2:
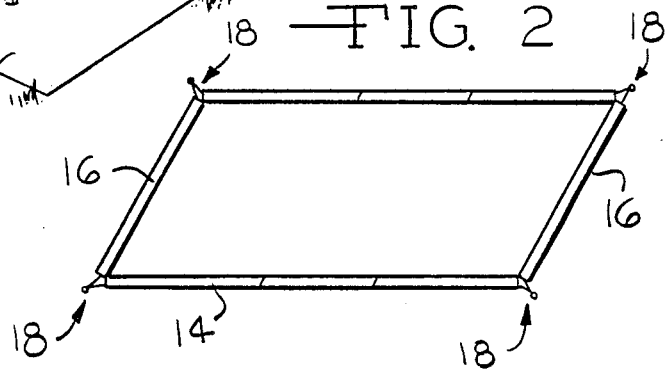
FIG. 2 is a top, plan view of the lower portion of a form for the production of concrete culverts according to the present invention.
Figure 9:
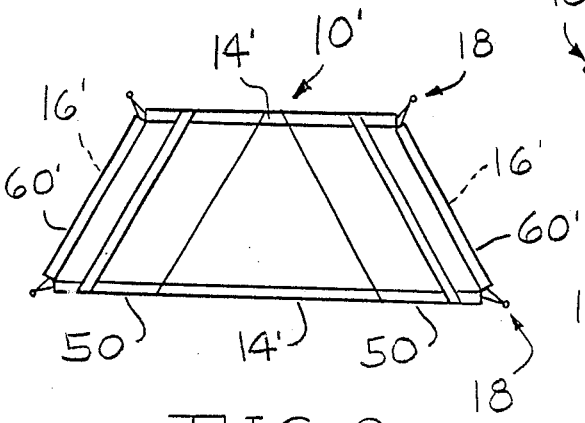
FIG. 9 is a top, plan view of a form according to the present invention configured for the production of a transitional culvert.
Figure 10:
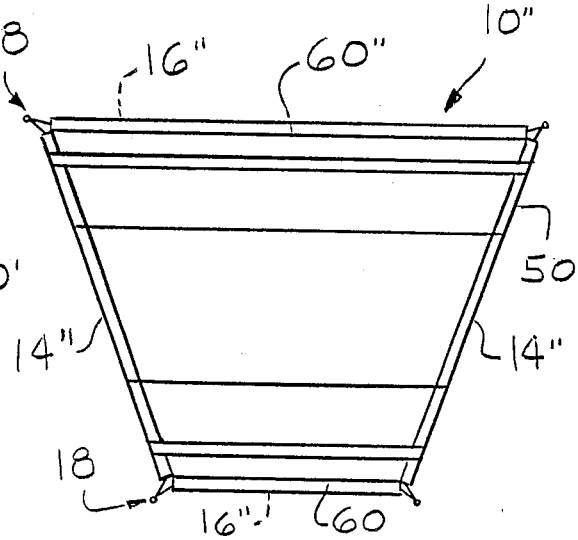
FIG. 10 is a top, plan view of a form according to the present invention configured for the production of a radial culvert.

Referring now to FIGS. 1 and 2, a culvert form for casting rectangular and skewed three-sided culverts is illustrated and generally designated by the reference numeral 10. The form 10 is preferably utilized upon and in conjunction with a horizontal smooth surface such as a previously cast concrete slab 12 or slab of other durable, substantially non-porous material. The slab 12 must be at least as large as and preferably slightly larger than the largest culvert fabricated thereon. The form 10 generally includes a first pair of longer, horizontally extending lower sidewalls 14 arranged in parallel and a second, shorter pair of horizontally extending lower sidewalls 16 also arranged in parallel which form a parallelogram and which are interconnected at their corners by four hinge assemblies 18. The parallelogram formed by the first pair of lower sidewalls 14 and the second pair of lower sidewalls 16 may be rectangular as illustrated in FIG. 1 or skewed as illustrated in FIG. 2. It should be understood at the outset that a significant purpose of the form 10 is its adaptability to various skewed, rectangular, radial, and transitional culvert sections and thus it should be understood that the form 10 may be adjusted and configured to define and produce various culverts. For example, with appropriate adjustment of the length of the lower sidewalls 14 and 16, the form 10 may also be arranged to produce a transitional culvert as illustrated in FIG. 9 or a radial culvert as illustrated in FIG. 10.

Each of the lower sidewalls 14 and 16 may either be a single length of channel beam 22 or similar structure such as the shorter, second pair of lower sidewalls 16 or may be assembled by butting together certain preselected lengths of the channel beams 22 as in the case of the first, lower set of sidewalls 14. In the latter case, the desired total length of the first pair of lower sidewalls 14 is achieved by assembling shorter lengths of channel beams 22 with splicing plates 24 and suitable fasteners 26. Thus it will be appreciated that the length of the first pair of lower sidewalls 14 and of the second pair of lower sidewalls 16 may be adjusted as desired to create a form having components of any desired length, width and angular arrangement.

Figure 3:
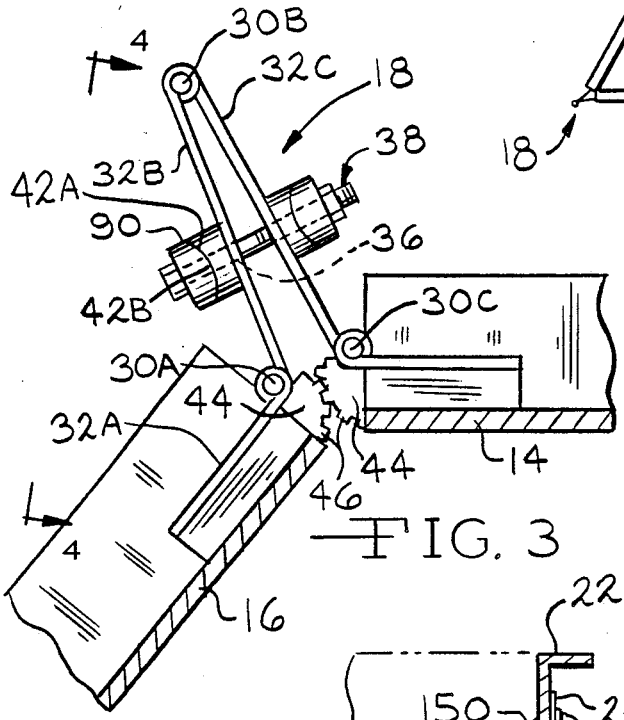
FIG. 3 is an enlarged, fragmentary plan view of a hinge structure utilized in the form of FIG. 1.
Figure 4:
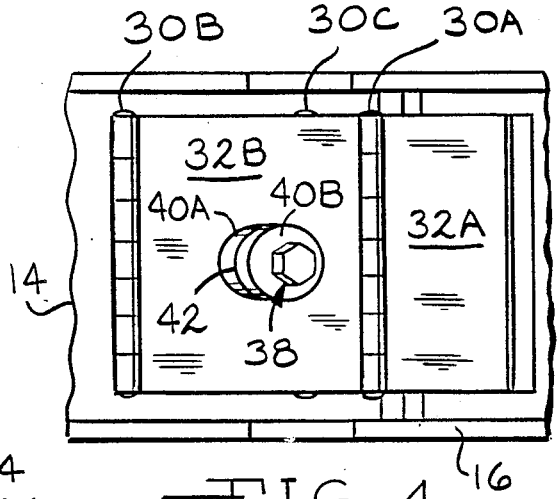
FIG. 4 is an enlarged, fragmentary elevational view of a hinge utilized in the form of FIG. 1.

Referring now to FIGS. 1, 3 and 4, an identical hinge assembly 18 is disposed at each intersection of the first and second lower pairs of sidewalls 14 and 16 and couples adjacent ends of the sidewalls together, as noted. The hinge assembly 18, in fact, is a triple pivot configuration having three hinge pins 30A, 30B, and 30C which are received within conventional aligned and interleaved portions of conventional hinge plates. A first hinge plate 32A is secured by welding or other suitable means to one of the lower sidewalls, for example, one of the second pair of lower sidewalls 16. The first hinge plate 32A is pivotally interconnected by means of the hinge pin 30A to a second hinge plate 32B which is in turn pivotally interconnected to a third hinge plate 32C by the second hinge pin 30B. The third hinge plate 32C is in turn pivotally secured to a fourth hinge plate 32D by the third hinge pin 30C. The second hinge plate 32B and third hinge plate 32C define generally aligned apertures 36B and 36C, respectively which cooperatively receives a fastener assembly 38 such as a bolt and nut. A pair of cylinders 40A and 40B having opposed, concave and convex surfaces 42A and 42B, respectively, oriented normal to the axis of the cylinder 40 are disposed between each end of the fastener assembly 38 and the outer face of the respective hinge plates 32B and 32C. The two pairs of cylinders 40A and 40B maintain the compressive forces generated by tightening the fastener assembly 38 generally normal to the faces of the respective hinge plates 32B and 32C in spite of skewing and angular misalignment thereof as will be readily appreciated.

The hinge assembly 18 also includes a pair of opposed curved surfaces 44 secured to the ends of the lower sidewalls 14 and 16 and having opposed mating spline assemblies 46. The spline assemblies 46 extend the full height of the pairs of lower sidewalls 16 and 18 and provide positive sealing against the flow of concrete through the corners of the form as well as providing positively engaging surfaces such that the form having once been adjusted to a particular angular relationship may be securely maintained therein by the tightening of the fastener assembly 38.

Given the manner in which the ends of the pairs of lower sidewalls 14 and 16 move relative to one another as the form is adjusted, fully engaged and rolling motion of the spline assemblies 46 may not be possible. That is, in order to achieve certain angular positions, it may be necessary that one spline assembly 46 on one lower sidewall be temporarily disengaged from the spline assembly 46 on the adjacent sidewall. In order to provide appropriate re-engagement of the spline assemblies 46, it should be understood that the splines of the spline assemblies 46 should be of relatively small size, that is, generally smaller than the splines illustrated in FIG. 3 which are enlarged to clearly illustrate the construction. Thus, such size should not be construed to represent the optimum spline size. Rather, finer spline assemblies 46 will permit more available positions of engagement and thus facilitate adjustment of the pairs of sidewalls 14 and 16 of the form assembly 10. Alternatively, the curved surfaces 44 of the spline assemblies 46 may be replaced with knurls or other surface treatment which provide appropriate frictional engagement between the curved surfaces 44.

Referring again to FIG. 1, it will be appreciated that the form 10 also includes two pair of triangular haunch sidewall panels 50. One pair of the haunch sidewall panels 50 are disposed on each of the first pair of lower sidewalls 14, one at each end thereof. The haunch sidewall panels 50 generally define a channel beam cross section similar to that of the lower pairs of sidewalls 14 and 16. The haunch sidewall panels 50 are generally triangular in elevation view but include an end adjacent region 52 which is parallel to the horizontal lower edge of the haunch sidewall panels 50. The haunch sidewall panels 50 are secured to the first pair of lower sidewalls 14 by threaded fasteners 54 such as nuts and bolts or by other suitable means such as tack welding. A pair of upper sidewalls 56 extend between the outermost ends of the haunch sidewall panels 50 at each end of the form 10. The upper sidewalls 56 are likewise of a channel beam construction and are secured by threaded fasteners 54 or tack welding to the aligned second pair of sidewalls 16 directly below. It will be appreciated that the upper sidewalls 56 may be of any length which is at least as great or greater than the length of the second pair of lower sidewall panels 16 as they may readily extend beyond the first pair of lower sidewalls panels 14 in either or both directions. Thus, it is not necessary to utilize the exact required length or assemble the upper sidewalls 56 from two or more sections. If desired or necessary, haunch top panels 58 may be positioned across the form 10 between the inclined faces of the haunch sidewall panels 50 to define the faces of the haunches.

Secured to the upper edges of the haunch sidewall panels 50, specifically the parallel end adjacent region 52 and the upper edge of the upper sidewalls 56, is a parallelogram leg form 60 which defines and forms the legs of the culvert. The leg form 60 may be fabricated of steel, and thus be reusable or may be fabricated of wood or other similar material as desired. The leg form 60 will be arranged such that the sides will be parallel to those portions, namely, the end adjacent regions 52 of the haunch sidewall panels 50 and upper sidewalls 54 of the lower form, to which they are attached. Thus, the leg forms 60 will define internal corner angles corresponding to the related corners of the lower sidewalls 14 and 16. The height of the leg forms 60 is selected to provide the necessary and appropriate height to the legs of the culvert. The height of the leg forms 60 and thus the legs may be unequal, if desired, to match the terrain upon which the culvert will be installed.

Inspection of the form construction of FIG. 1 reveals a unique feature and several consequential benefits of the present apparatus and method. First of all, the casting of the culvert in an inverted orientation utilizes the slab 12 as a form for the largest surface thereof. Furthermore, it is also repeatedly and nearly indefinitely reusable without any modification or adjustment. Thus, the largest surface of the culvert is formed, not by the form 10 itself, but by the least complicated and most readily reusable of forms, a horizontal slab, the slab 12. Secondly, and of almost equal significance, is an analogous benefit relating to what will typically be the second largest surface of the culvert: the underside between the haunches and the haunch top panels 58. This surface is open, i.e., without a form, and may be screeded and finished in accordance with conventional concrete finishing practices. Here, as well, this major surface of the culvert is produced without the need for an adjustable and/or costly form panel. Thus, it will be appreciated that the form 10 according to the present invention is substantially open at the top and bottom of the portions forming the horizontal slab. The form 10, itself, thus has greatly reduced surface area for any given culvert size relative to other designs. This results in significant economy due to the reduced material required to construct the form 10 relative to prior art form configurations. The form 10 is thus of lighter weight and more readily transportable than prior art forms. Because of the reduced number of form panels, there are also fewer connecting and adjusting assemblies which also reduces the cost of the form and improves its reliability and ease of use.

Referring now to FIG. 9, the flexibility of the culvert form 10 will be appreciated in that it is now configured to produce a transitional culvert, that is, a culvert tapering from a first, wider face or opening to a second, narrower face or opening. The transitional culvert form 10' includes a pair of parallel, first lower sidewalls 14' of unequal lengths and a pair of non-parallel, second lower sidewalls 16' of equal length. The pair of equal length lower sidewalls 16' are arranged parallel to the leg forms 60' such that the legs of the culvert are of equal length. The span thus tapers from a wide face to a narrow face. The hinge assemblies 18 are identical to those disclosed with regard to the culvert form 10. The haunch sidewall panels 50 are disposed in opposed pairs at each end of the unequal length first lower sidewalls 14' and the leg forms 60' are configured with internal corner angles corresponding to the aligned corner angles of the pairs of lower sidewalls 14' and 16' upon which the leg forms 60' are placed.

Alternatively, the culvert form 10 may be rearranged to produce a radial culvert section as illustrated in FIG. 10 and designated 10''. The radial culvert form 10'' includes a first pair of non-parallel, equal length lower sidewalls 14'' and a second pair of parallel unequal length lower sidewalls 16''. Here, the pair of unequal length lower sidewalls 16'' are arranged parallel to the leg forms 60'' such that the legs of the culvert are of unequal length. The faces of the culvert are, however, equal in length.

In a conventional installation, a plurality of the three-sided culverts produced by forms 10, 10' and 10'' according to the instant invention will typically be arranged with faces and horizontal upper spans of one culvert juxtaposed corresponding sections of another as illustrated in FIG. 1 of U.S. Pat. No. 4,564,313. In such an arrangement, the outer culverts will typically include means for securing a guard rail or other barrier to the edge of the culverts to act as a safety barrier. Conversely, on the inner faces of the culverts, that is, those faces abutting an adjacent culvert, keys are formed to receive grout to interconnect the two culverts. The following sections refer to and describe various components which provide for the mounting of guard rails and the like and which form the grout receiving keys.

Figure 6:
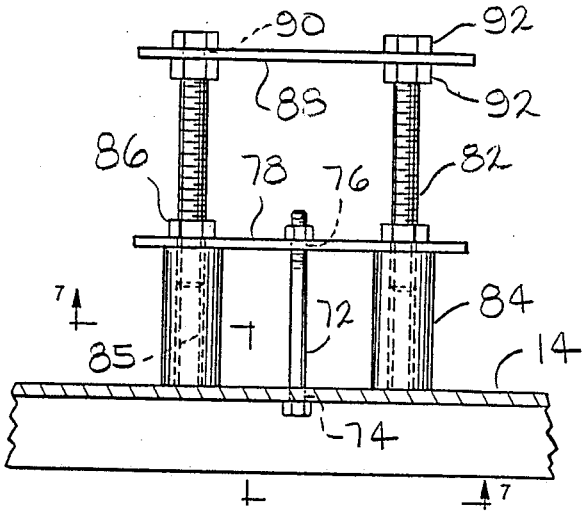
FIG. 6 is an enlarged, fragmentary plan view of guard rail securement structures.
Figure 7:
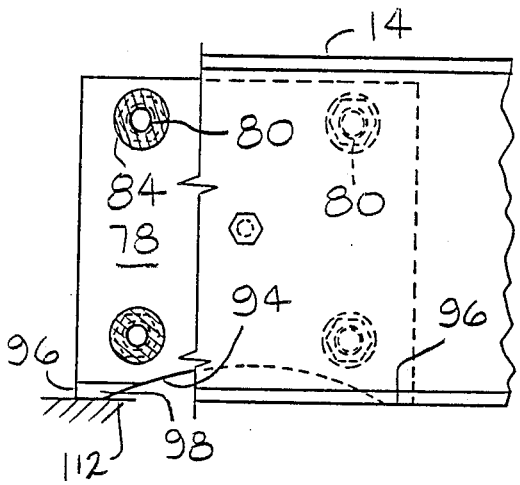
FIG. 7 is a side, elevational view in partial section of guard rail securement structures taken along line 7-7 of FIG. 6.

With reference to FIGS. 6 and 7, a first embodiment guard rail securing assembly 70 is illustrated. The guard rail securing assembly 70 is attached to one of the first, pair of lower sidewalls 14. The entire assembly 70 is maintained in place during the pouring of the culvert by a single machine bolt 72 which passes through a small, suitably sized aperture 74 in the vertical wall of the one of the first pair of lower sidewalls 14. Since the culvert form 10 is adjustable and since the guard rail securing assembly 70 will therefore necessarily be positioned at various intervals along the length of one of the first pair of lower sidewalls 14, a plurality of apertures to facilitate its positioning and spacing is required. Thus, typically a plurality of the apertures 74 will be spaced along the length of the lower sidewall 14 as illustrated in FIG. 1. However, each of the apertures 74 is of a size sufficiently small that the concrete will not flow therethrough so that no patching or covering need be placed over the unused apertures 74.

The machine bolt 72 is received within a suitably sized aperture 76 in a first plate 78. The first plate 78 also defines a plurality of apertures 80 disposed in an array which receives a like plurality of larger machine bolts or threaded rods 82. The machine bolts 82 are received within a respective one of a like plurality of complementarily internally threaded sleeves 84. The internal threads 85 of the sleeves 84 receive threaded fasteners (not illustrated) which secure the guard rail to the outer face (edge) of the culverts. The threaded sleeves 84 are held against the inner face of the lower sidewall 14 by the first plate 78 and the first plate 78 is secured to the bolts or rods 82 by suitably positioned and tightened nuts 86. A second plate 88 is spaced from the first plate 78 and likewise includes an array of apertures 90 through which the machine bolts or threaded rods 82 pass. The second plate 88 is secured to the bolts or rods 82 by nuts 92 and the bolt heads 92 or by pairs of nuts 92 as will be readily understood. The first plate 78 and the second plate 88 provide suitable stability to the threaded sleeves 84 during the casting process while the machine bolt 72 maintains their position adjacent the sidewall 14.

The first and second plates 78 and 88, respectively, are also supported by the slab 12. A lower portion of both the first and second plates 78 and 88 defines an arcuate profile 94 having a pair of legs 96 in contact with the concrete slab 12. Since the surface contacting the slab 12 becomes the upper surface of the culvert, the points of interruption of the surface of the culvert are minimized by the small areas of the legs 96 as will be readily appreciated. The pair of legs 96 are preferably coated with a protective material 98 such as an epoxy based coating to protect them against deleterious environmental conditions such as road salt and the like.

Figure 8:
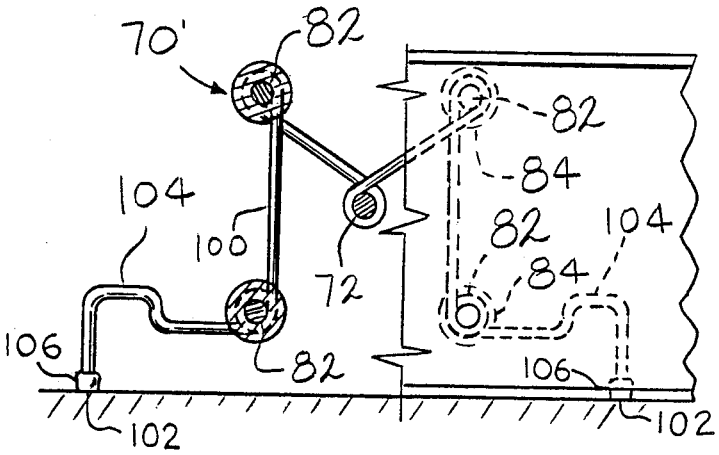
FIG. 8 is a side, elevational view in partial section of an alternate retaining wall securement structure.

Referring now to FIG. 8, a first alternate embodiment guard rail securing assembly 70' is illustrated. Instead of flat plates 78 and 88 utilized in the first embodiment, the second embodiment guard rail assembly 70' utilizes a formed wire 100 which is shaped to receive the machine bolts or threaded rods 82 and the machine bolt 72. The formed wire 100 is secured to the threaded rods 82 and the threaded spacers 84 by the use of nuts 86 and 92 in a manner identical to that mode of securement of the preferred embodiment assembly 70. It is anticipated that one of a pair of the formed wires 100 will be utilized in each position comparable to the first plate 78 and second plate 88 of the preferred embodiment assembly 70.

A first benefit of the first alternate embodiment guard rail securing assembly 70' is the small points of contact and thus interruption in the surface of the concrete represented by the ends 102 of the formed wire 100 A second feature of the formed wire 100 is a U-shaped or re-entrant portion 104 disposed between the end of the formed wire 102 and the bolts or threaded rods 82 and spacers 84 most proximate the upper surface of the culvert and the slab 12. When the culvert is inverted and placed in service, the re-entrant portion 104 acts as a sump or well to prevent flow of a corrosive liquid such as salt water further into the interior of the cast concrete of the culvert. The ends 102 of the formed wire 100 are preferably coated with a protective material 106 such as an epoxy based coating to protect them against deleterious environmental conditions such as road salt and the like.

Referring now to FIG. 11, a completed culvert 108 is illustrated within the culvert form 10. The concrete has set and the leg forms 60 have been removed. Also, the fastener assemblies 38 of the hinge assemblies 18 have been removed and the pairs of lower sidewalls 14 and 16 have been opened. The culvert 108 may thus be readily removed from the form 10.

Referring now to FIGS. 12, 13 and 14, an alternate embodiment hinge construction is illustrated. As illustrated in FIGS. 13 and 14, one end of one of the first pair of lower sidewalls 14 is releasably interconnected to one of the ends of one of the second pair of lower sidewalls 16 by a hinge assembly 110. Although only one of the hinge assemblies 110 has been illustrated, it will be appreciated that an identical hinge assembly 110 will be utilized at each corner of the form 10. The hinge assembly 110 includes a first hinge plate 112 secured to or formed integrally with the first lower sidewall 14 and a second hinge plate 114 secured to or formed integrally with the second lower sidewall 16. In accordance with conventional construction, each of the hinge plates 112 and 114 includes a plurality of complementarily spaced apart ears or pivots which are interleaved and define a through passageway 116. The through passageway 116 receives a hinge pin 118. Preferably the hinge pin 118 includes an enlarged diameter stop portion 120 which inhibits translation of the hinge pin 118 through the hinge plates 112 and 114 and a head 122 such as an eyelet or other readily engageable structure which facilitates gripping of the hinge pin 118 and thus insertion and removal from the hinge plates 112 and 114, as will be readily appreciated. As illustrated in FIG. 12, one or more of the hinge pins 118 may be removed and the form 10 opened to facilitate removal of a completed culvert 108 therefrom.

It will also be appreciated that the alternate embodiment hinge construction does not provide means to maintain the hinges and specifically the pairs of lower sidewalls 14 and 16 in a fixed position as does the preferred embodiment hinge construction illustrated in FIGS. 3 and 4. Accordingly, it is desirable to provide means whereby the pairs of lower sidewalls 14 and 16 and hence the form 10 may be maintained in a desired position. Although the form 10 is disposed upon the slab 12 as illustrated, it is preferable not to drill into or otherwise insult the surface of the slab 12 as it will require patching after each repositioning of the form 10. If not patched, it will become severely pock marked and the surface finish of the culverts 108 will be adversely affected. It is therefore preferable to secure the pairs of lower sidewalls 14 and 16 by means external to the slab. This may be accomplished by utilizing bars or rails 126 which are secured by suitable fasteners 128 to the pairs of lower sidewalls 14 and 16. The opposite ends of the bars or rails 126 may be attached and secured to any appropriate stationary structure (not illustrated) such as stakes or rods driven into the ground or fastened to other structures. Although only two of the rails 126 at one corner of the form have been illustrated, it should be understood that two rails 126 will preferably be utilized at each corner of the form.

Figure 5:
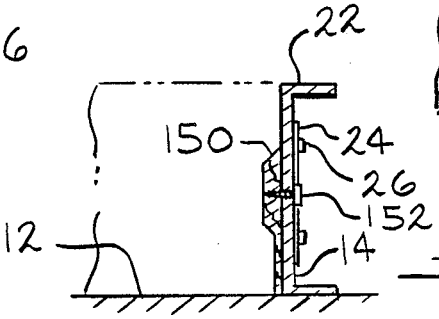
FIG. 5 is a fragmentary, sectional view of the sidewall of the form of FIG. 1, taken along line 5-5 of FIG. 1.

Referring now to FIGS. 1, 5, and 15, it will be appreciated that on the faces of the culvert 108 which will be positioned adjacent like faces of additional culverts, a pair of vertical keys 142 and an intersecting horizontal key 144 are formed. The vertical keys 142 are formed by the placement of suitably shaped inserts 148 within the leg forms 60. The inserts 148 are preferably secured to the end walls of the forms 60 by threaded fasteners such as screws or dowel hangers and nuts (not illustrated). The horizontal key 144 is likewise formed by an insert 150 extending along the first pair of lower sidewalls 14. The insert 150 may be of wood or other similar material and again may be secured to the lower sidewalls 14 by threaded fasteners such as wood screws 152.

With reference now specifically to FIG. 15, when similarly sized faces of the culverts 108 are juxtaposed, the vertical keyways 142 and horizontal keyways 144 align. The keyways 142 and 144 may then be filled with grout 146 or similar substance to couple the adjacent culverts 108 together and thereby minimize relative motion therebetween.

Figure 16:
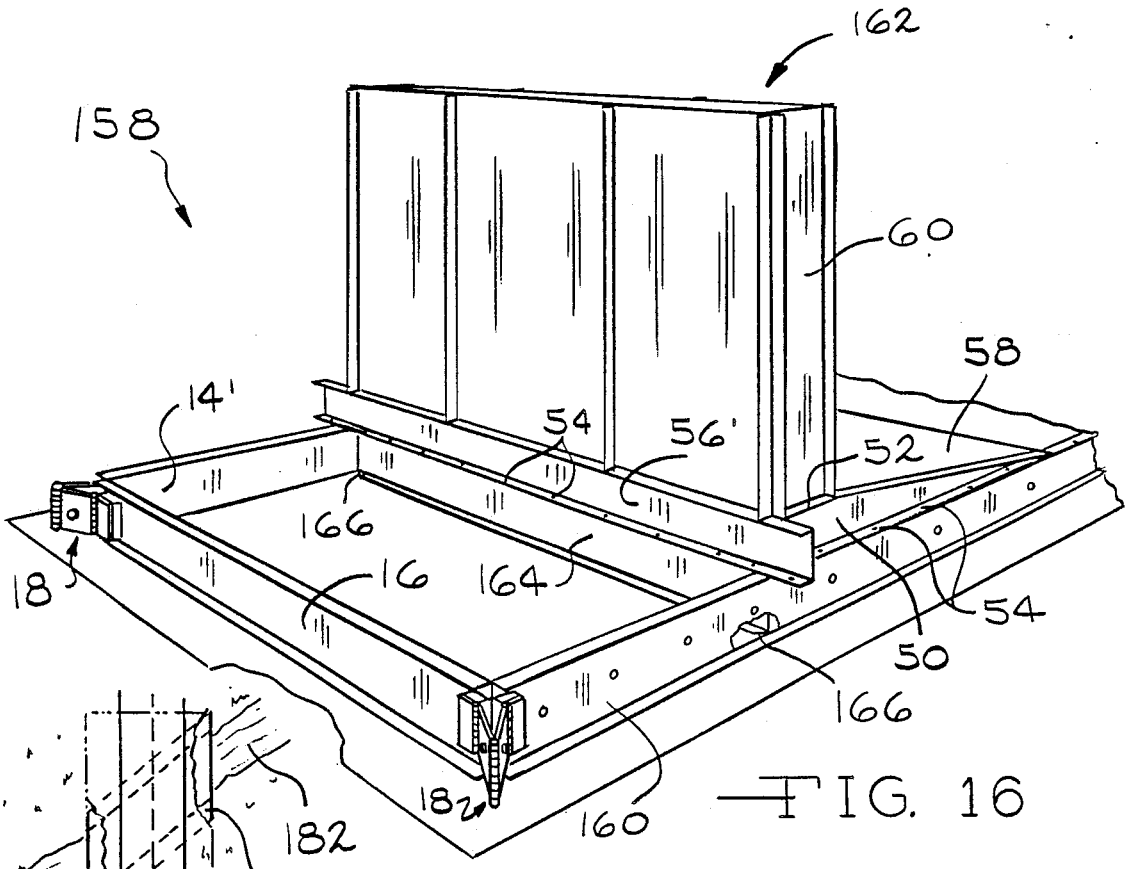
FIG. 16 is a fragmentary, perspective view of an alternate embodiment of a form for the production of concrete culverts according to the present invention.

Referring now to FIG. 16, an alternate embodiment form 158 for the production of both skewed and rectilinear three-sided concrete culverts is illustrated. The first alternate embodiment form 158 is generally similar to the preferred embodiment form 10 and includes a first pair of longer, horizontally extending lower sidewalls 160. The first pair of lower sidewalls 160 may be of fixed length, that is, not assembled from two or more channel beams 22 spliced together with splicing plates 24 and suitable fasteners 26 as is the case in the preferred embodiment culvert form 10 and specifically the first pair of lower sidewalls 14 illustrated in FIG. 1. The length of each of the first pair of lower sidewalls 160 is preferably equal and sufficient to enable fabrication of the longest span culvert desired to be produced in the alternate embodiment form 158. In other words, it is preferred and anticipated that once a particular length first pair of lower sidewalls 160 has been selected, additions to said length will not be necessary.

Interconnecting the ends of the first pair of lower sidewalls 160 are a second, shorter pair of lower sidewalls 16, one of which is illustrated in FIG. 16. The second pair of lower sidewalls 16 are in all respects identical to the second pair of lower sidewalls 16 utilized in the preferred embodiment culvert form 10. The ends of the first and second pairs of lower sidewalls 160 and 16 are pivotally and expandably interconnected by four hinge assemblies 18. The hinge assemblies 18 are identical to those utilized in the preferred embodiment culvert form 10 and thus will not be further described. One end of the first alternate embodiment form 158 and specifically the haunch sidewall panels 50, the upper sidewall 56, the haunch top panels 58 and the leg form 60 is identical in all respects to those found at either end of the preferred embodiment culvert form 10 illustrated in FIG. 1.

At the opposite end of the alternate embodiment form 158, that is, that end illustrated in FIG. 16, are the distinctions which render this embodiment different from that of the preferred embodiment culvert form 10 illustrated in FIG. 1. These distinctions center upon the haunch and leg forming assembly 162 which is slidably received within and may be moved along the first pair of lower sidewalls 160. The haunch and leg forming assembly 162 includes a single lower sidewall panel 164 which extends between the first pair of lower sidewalls 160. The single lower sidewall panel 164 is preferably a channel beam similar to the other lower sidewalls. The ends of the single lower sidewall panel 164 include relieved or bevelled corners 166 such that ends of the single, lower sidewall panel 164 will remain in intimate contact with the inside surfaces of the first pair of lower sidewalls 160 when the alternate embodiment form 158 is skewed.

The haunch and leg forming assembly 162 further includes an upper sidewall 56' which is secured to the lower sidewall 164 by threaded fasteners 54 or tack welding. The upper sidewall 56' may be the same length as the lower sidewall 164 or may be longer than the lower sidewall panel 164 and extend beyond the lower sidewalls 160 inasmuch as it is disposed above them. The length of the upper sidewall 56' is preferably at least as long as the greatest width of a culvert desired to be fabricated, thereby minimizing the number of total parts of the form 158 inasmuch as it may be used to fabricate all narrower culverts.

Haunch sidewall panels 50 which are likewise identical to the haunch sidewall panels 50 of the preferred embodiment extend toward the opposite ends of the form 160 and are secured by threaded fasteners 54 or tack welding to the first pair of lower sidewalls 14'. The haunch sidewall panels 50 generally are triangular in a side, elevation view but include an end adjacent region 52 which is parallel to the horizontal, lower edge of the haunch sidewall panels 50. To the horizontal, end adjacent region 52 and to the upper surface of the upper sidewall panel 56 is positioned and secured a leg form 60 which defines and forms the legs of the culvert. The leg form 60 in all respects identical to and utilized in the preferred embodiment. Thus it may include an insert 148 (illustrated in FIG. 1) for forming the keyway. It will thus be appreciated that the first alternate embodiment form 160 provides a means for conveniently fabricating rectilinear and skewed culverts having varying spans which may be readily accommodated by merely sliding and securing the haunch and leg forming assembly 162 along the inside of the first pair of lower sidewalls 14' and securing it thereto at the position which represents the desired span of the culvert.

Figure 18:
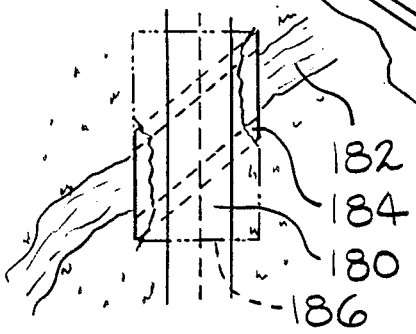
FIG. 18 is a top, plan view of an installation of a plurality of skewed, three sided culverts according to the present invention.
Figure 17:
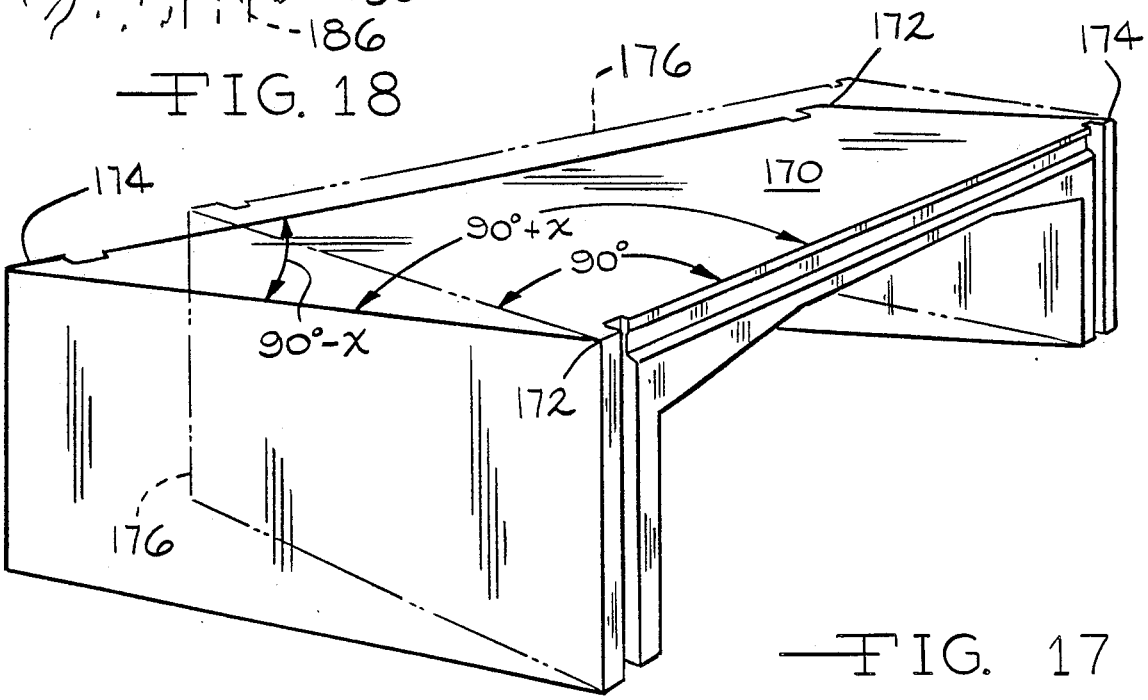
FIG. 17 is a perspective view of a skewed, three sided culvert according to the present invention wherein reference lines represent the outline of a conventional rectangular culvert.

FIGS. 17 and 18 illustrate the installation of an individual skewed, three sided culvert 170 fabricated according to the instant method and using the herein disclosed apparatus. The skewed culvert 170 typically includes diagonally opposite corners 172 defining an angle in plan view of greater than 90° and alternate, diagonally opposed corners 174 having an angle less than 90°. For reference purposes and because a perspective view of the skewed culvert 170, though showing in good detail the structure and general features, does not clearly indicate the skew thereof, dashed reference lines 176 have been superimposed upon the skewed culvert 170 to provide a visual indication of a culvert wherein all four corner angles when viewed in plan are 90°.

Skewed culverts such as the culvert 170 are practical and confer significant cost benefits when, as described previously, the angle of intersection between the crossed obstacle and the crossing structure is other than 90°. For example, in FIG. 18, a roadway 180 is shown crossing a stream 182 at an angle of approximately 30°. Thus, the culverts 184 which may be of a skewed design such as the skewed culvert 170 illustrated in FIG. 17, may be utilized economically to provide crossing over the stream 182 with a minimum of material and expense. If skewed culverts such as the culverts 184 were not utilized, the course of the stream 182 might be redirected to cross the roadway 180 at a right angle. This activity raises the question of whether such a course diversion would be maintained or subsequently create a site for obstruction of the water flow. A third alternative to using skewed structures or redirecting the stream 182 however, would be to utilize an installation of rectangular culverts as illustrated by the dashed lines 186. It is apparent that such an installation would be far more costly than an installation of skewed culverts 184.

The production method of the culverts 108 or 170 will now be described with reference to all of the drawing figures, especially FIGS. 1, 5, 7, 11, 12 and 15.

First of all, the desired length of the first and second pair of lower sidewalls, 14 and 16, respectively, are chosen. This may comprise the assembly of several lengths of the channel beam 22 which are spliced together with the splicing plates 24 and suitable fasteners 26 or the selection of a single channel beam 22 that extends the full length of the edge portion of the culvert 108 to be formed. The chosen lengths of the lower sidewalls 14 and 16 may form a parallelogram, i.e., parallel opposed sidewalls as illustrated in FIG. 2, parallel: unequal length first lower sidewalls 14' and converging, equal length second lower sidewalls 16' as illustrated in FIG. 9, which forms a transitional culvert; or equal length first lower sidewalls 14' and unequal length second lower sidewalls 16' as illustrated in FIG. 10 which creates a radial culvert.

The adjacent ends of the lower sidewalls 14 and 16 are connected together by means of the pivoting and expandable hinge assembly 18 as illustrated in FIGS. 3 and 4. The fastener assemblies 38 are loosened such that the interconnected pairs of lower sidewalls 14 and 16 may be arranged as desired into the rectangular shape illustrated in FIG. 1 or skewed to a desired angle as illustrated in FIG. 2. The fastener assemblies 38 of each of the hinge assemblies 18 are then tightened to engage the opposed spline assemblies 46 on the curved surfaces 44, not only to seal the ends of the adjacent lower sidewalls 14 and 16 to prevent escape of the concrete during filling but also to secure and maintain the first and second pair of lower sidewalls 14 and 16 in their desired relative orientation to one another.

Alternatively, the alternate embodiment hinge assemblies 110 illustrated in FIGS. 13 and 14 are assembled by the interleaving of hinge plates 112 and 114, the pins 118 inserted and the pairs of lower sidewalls 14 and 16 arranged as desired. Securing rails 126 are next positioned as needed to maintain the position of the form 10.

Next, the haunch sidewall panels 50 and the pair of upper sidewalls 56 are positioned upon the pairs of lower sidewalls 14 and 16 and secured by threaded fasteners 54 or other suitable means. A framework of reinforcing rods (not illustrated) is then prepared and placed within the form 10. Such framework of reinforcing rods is preferably in accordance with recognized standards such as those promulgated by ASHTO or similar standards. Next, the leg forms 60 are positioned on the upper, end adjacent region 52 of the haunch sidewall panels 50 and the upper pair of sidewalls 56 as illustrated in FIG. 1 and secured thereto. Inserts 148 and 150 forming the vertical grout keys 142 and horizontal grout keys 144 respectively may now be secured to appropriate panels of the form 10 by suitable means such as wood screws 152 and the like.

Inserts such as the guard rail securing assembly 70 or the first alternate embodiment guard rail securing assembly 70' illustrated in FIGS. 6, 7 and 8 are attached to the first pair of lower sidewalls 14' or 14'' as will be readily appreciated.

The form 10 is now ready to be filled with concrete. When the concrete has set, the leg forms 60 may be removed. Then, the fastener assembly 38 of each of the hinge assemblies 18 or at least one of the hinge pins 118 may be released and the form expanded about the culvert 108 as illustrated in FIGS. 11 or 12 and readily removed. Finally and prior to installation, the culvert 108 is rotated into the vertical, upright position illustrated in FIG. 15. Installation and grouting of juxtaposed culverts 108 as also illustrated in FIG. 15 is accomplished in accordance with conventional practice.

Thus it is apparent that the present invention provides both an apparatus and method for the fabrication, in an inverted position, of a wide variety of rectangular, skewed, transitional and radial three-sided culverts having various optional inserts. The culvert form 10 is unique in that, generally, its two largest surfaces, the regions forming the top and bottom of the culvert span, are open. The form 10 thus utilizes less material and is lighter than prior art configurations.

The foregoing disclosure is the best mode devised by the inventor for practicing this invention. It is apparent, however, that concrete forms and methods incorporating modifications and variations will be obvious to one skilled in the art of culvert forms and methods. Inasmuch as the foregoing disclosure is intended to enable one skilled in the pertinent art to practice the present invention, it should not be construed to be limited thereby but should be construed to include such aforementioned obvious variations and be limited only by the spirit and scope of the following claims.

I claim:

1. A form for fabricating concrete structures on a horizontal surface comprising, in combination, four sidewall panels disposed in two opposed pairs, each of said sidewall panels having ends, four hinge means for interconnecting adjacent said ends of said opposed pairs of sidewall panels, said hinge means having means for releasably and pivotally interconnecting said ends of said sidewall panels, means for maintaining said ends of said sidewall panels in a pre-selected angular orientation, a pair of opposed haunch forms secured to said sidewall panels opposite said horizontal surface for forming haunches and a pair of leg forms, each of said leg forms secured to a respective one of said pair of haunch forms and having at least one wall disposed parallel to one of said sidewall panels.

2. The form of claim 1 further including support means secured to one of said sidewall panels for supporting a plurality of internally threaded members.

3. The form of claim 1 wherein said hinge means includes a pair of interleaved pivots and a pin received within and releasably coupling said pivots, said pin including a stop and a head extending axially beyond said stop.

4. The form of claim 1 wherein at least one of said four hinge means includes a plurality of pivot pins pivotally connecting a plurality of hinge plates.

5. The form of claim 1 wherein at least one of said four hinge means includes four hinge plates serially interconnected by three hinge pins, one of said hinge plates secured to an adjacent one of said ends of said sidewall panels forming a corner and another of said hinge plates secured to another of said ends of said sidewall panels forming said corner.

6. The form of claim 4 wherein said means for maintaining said ends of said sidewall panels in a pre-selected angular orientation further includes means for clamping together said hinge plates, and spline assemblies secured to said ends of said sidewall panels.

7. A form for fabricating three sided concrete structures on a horizontal surface comprising, in combination, four lower sidewall panels disposed in two opposed pairs, each of said sidewall panels having ends and at least one of said pairs of sidewall panels disposed in parallel, four expandable hinges interconnecting adjacent said ends of said opposed pairs of sidewall panels, said hinges having means for pivotally interconnecting said ends of said sidewall panels and for expanding to facilitate removal of said structure from said form and means for maintaining said ends of said sidewall panels in a pre-selected angular orientation, and a pair of opposed haunch form means secured to said lower sidewall panels opposite said horizontal surface for forming haunches and a pair of leg forms, each of said leg forms secured to a respective one of said pair of haunch forms and defining a parallelogram in cross section.

8. The form of claim 7 wherein a first two of said lower sidewall panels are of equal length and a second two of said sidewall panels are of equal length different from the length of said first two sidewall panels.

9. The form of claim 7 wherein two of said lower sidewall panels are of equal length and two of said sidewall panels are of unequal length.

10. The form of claim 7 wherein at least one of said haunch form means includes a fifth lower sidewall panel extending between one of said opposed pairs of lower sidewall panels, an upper sidewall panel being secured to said fifth lower sidewall panel and having a length at least as long as said fifth lower sidewall panel.

11. A form for fabricating concrete structures on a horizontal surface comprising, in combination, four sidewall panels disposed in two opposed pairs, each of said sidewall panels having ends, said four sidewall panels defining the periphery of one wall of the structure, four hinge means for interconnecting adjacent said ends of said opposed pairs of sidewall panels, said hinge means having means for releasably and pivotally interconnecting said ends of said sidewall panels, means for maintaining said ends of said sidewall panels in a pre-selected angular orientation, and a pair of opposed haunch forms secured to the upper portion of said sidewall panels for forming haunches, and a pair of four-sided leg forms, each of said pair of leg forms secured to the upper portion of a respective one of said pair of haunch forms.

12. The form of claim 11 further including support means secured to one of said sidewall panels for supporting a plurality of internally threaded members.

13. The form of claim 11 wherein said hinge means includes a pair of interleaved pivots and a pin received within and releasably coupling said pivots, said pin including a stop and a head extending axially beyond said stop.

14. The form of claim 11 wherein at least one of said four hinge means includes a plurality of pivot pins pivotally connecting a plurality of hinge plates.

15. The form of claim 11 wherein at least one of said four hinge means includes four hinge plates serially interconnected by three hinge pins, one of said hinge plates secured to an adjacent one of said ends of said sidewall panels forming a corner and another of said hinger plates secured to another of said ends of said sidewall panels forming said corner.

* * * * *